US005853081A

United States Patent [19]

Hastie

[11] Patent Number: 5,853,081

[45] Date of Patent: Dec. 29, 1998

[54] GATHERING CHAIN FOR HIGH SPEED BINDERY LINES AND PUSHER MEMBER THEREFOR

[75] Inventor: Ronald W. Hastie, Elk Grove Village, Ill.

[73] Assignee: R. R. Donnelley & Sons Company, Chicago, Ill.

[21] Appl. No.: 678,818

[22] Filed: Jul. 12, 1996

[51] Int. Cl.[6] ..... B65G 49/00

[52] U.S. Cl. ..... 198/644; 198/698; 198/733; 198/841; 270/52.29

[58] Field of Search ..... 198/644, 841, 198/698, 733; 271/175; 270/52.14, 52.16, 52.26, 52.29

[56] References Cited

U.S. PATENT DOCUMENTS

| | | | |
|---|---|---|---|
| 668,079 | 2/1901 | Baker | 198/698 |
| 1,297,322 | 3/1919 | Christensen . | |
| 1,348,849 | 8/1920 | Christensen . | |
| 1,360,886 | 11/1920 | Christensen | 198/644 |
| 1,492,760 | 5/1924 | Sproul . | |
| 1,601,802 | 10/1926 | Kast . | |
| 1,651,122 | 11/1927 | Hoffert | 198/644 X |
| 2,223,391 | 12/1940 | Schweizer | 271/12 |
| 2,810,468 | 10/1957 | Faeber et al. | 198/133 |
| 3,147,850 | 9/1964 | Ronceray | 198/698 |
| 3,591,165 | 7/1971 | McCahon et al. | 270/54 |
| 3,809,384 | 5/1974 | Zugel | 270/54 |
| 4,164,159 | 8/1979 | Marciniak | 83/280 |
| 4,236,706 | 12/1980 | Schlough | 270/53 |
| 4,519,599 | 5/1985 | Mayer | 270/53 |
| 4,522,384 | 6/1985 | Beckley | 270/54 |
| 4,546,961 | 10/1985 | Majewski et al. | 270/53 |
| 4,546,962 | 10/1985 | Backman | 270/54 |
| 4,556,143 | 12/1985 | Johnson | 198/841 |
| 4,968,017 | 11/1990 | Depetris | 271/12 |
| 5,028,193 | 7/1991 | Misicka | 412/8 |
| 5,067,699 | 11/1991 | Gadway et al. | 270/55 |
| 5,375,824 | 12/1994 | Anker et al. | 270/53 |
| 5,547,066 | 8/1996 | Chang | 198/644 |

FOREIGN PATENT DOCUMENTS

| | | | |
|---|---|---|---|
| 0172684 | 12/1991 | United Kingdom | 198/644 |

*Primary Examiner*—Joseph E. Valenza
*Attorney, Agent, or Firm*—Marshall, O'Toole, Gerstein, Murray & Borun

[57] ABSTRACT

A gathering chain pusher member for use in a gathering conveyor system is configured in a manner to allow high speed binding to occur without deformation of signatures collected by the system.

29 Claims, 3 Drawing Sheets

GATHERING CHAIN FOR HIGH SPEED BINDERY LINES AND PUSHER MEMBER THEREFOR

TECHNICAL FIELD

The present invention relates generally to gathering chains for bindery lines, and more particularly to a gathering chain having high speed capability.

BACKGROUND ART

A conveyor is frequently used to move signatures between a number of operating stations. Signatures typically comprise one or more pages which are formed into books, such as catalogs, magazines, pamphlets, etc. . . . The operating stations, which are supplied with signatures by the conveyor, perform selected operations upon those signatures, including collating, trimming, binding and the like.

One known conveyor for conveying signatures to various operating stations includes a plurality of inverted V-shaped gathering chain segments suitably attached to a chain which is propelled by one or more motor driven sprockets. Each of the inverted V-shaped gathering chain segments has a pair of depending legs joined at an apex. Pusher pins are inserted through aligned openings in the depending legs of selected gathering chain segments to form chain spaces. Signatures are dropped onto the conveyor in the chain spaces into engagement with the pusher pins so that the backbones of the signatures ride on the chain segments.

One existing pusher pin has a generally arcuate body having a ridge on a surface thereof. The ridge engages with one of the depending legs of the gathering chain segment to prevent the pusher pin from being pushed all the way through the openings of the gathering chain segment. Once inserted, the ends of the pusher pin point in an upward direction so as to engage a signature and thereby facilitate both the gathering of the signature and the movement of the signature by the gathering chain.

A pusher pin of this design strikes the signatures with a highly localized force during the gathering operation. As the speed of the gathering chain increases, the striking force of the gathering chain pusher pin increases and at the higher speeds of such a bindery line this force leaves indentations on the signatures. Besides being unsightly, these deformations can cause the produced book to have a bulge which interferes with the proper operation of downstream devices, such as a book caliper, trimming apparatus, or the like.

SUMMARY OF THE INVENTION

In accordance with the present invention, a plurality of gathering chain pusher pins are arranged on a gathering conveyor system and are configured in a manner to allow high speed binding to occur without significant deformation of the signatures.

More specifically, according to one aspect of the present invention, a gathering chain includes a plurality of segments which are joined to one another and extend in a travel direction wherein each segment has a width transverse to the travel direction and includes a top surface. The gathering chain includes a pusher member having a portion of uniform thickness disposed atop one of the segments in contact with the top surface over the entire width of such segment and adapted to engage signatures deposited on the gathering chain. Preferably, the one segment and the pusher member have an inverted V-shape and include means for attaching the pusher member to the one segment. The attaching means may comprise a threaded bolt extending through an aperture in the pusher member wherein the one segment carries a member having a threaded bore therein and wherein the threaded bolt is captured within the threaded bore.

According to another aspect of the present invention, a conveyor system includes a gathering chain including a plurality of chain links which move in a closed loop defined in part by a return path of travel. A rail extends parallel to the gathering chain adjacent to the return path of travel and a plurality of tabs are carried by the chain links and engage the rail wherein the chain is supported by the rail along the return path of travel.

According to yet another aspect of the present invention, a gathering chain comprising a pusher member having a portion of substantially uniform thickness disposed atop one of the segments and over the entire width of the segment, further adapted to engage signatures deposited on the gathering chain and means for securing the pusher member to the segment.

Accordingly, this invention permits high speed binding to occur without deformation by distributing forces over an area of the signature, including the backbone, which is the strongest portion, and allows for an unobstructed closed loop travel of the conveyor system containing the gathering chain and all its components.

BRIEF DESCRIPTION OF THE DRAWINGS

These and other features and advantages will become more apparent from a detailed consideration of the invention when taken in conjunction with the drawings in which.

DESCRIPTION OF THE PREFERRED EMBODIMENTS

Figure 1:
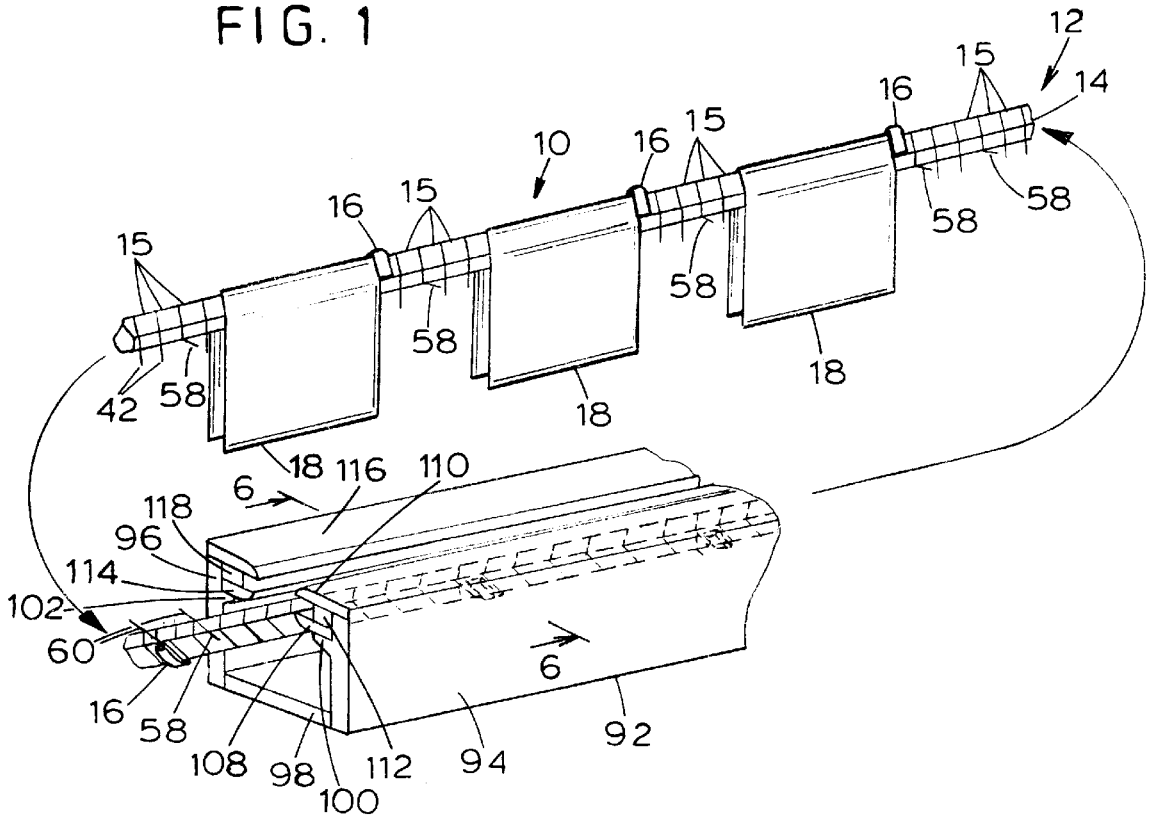
FIG. 1 is an isometric fragmentary view of a portion of a conveyor system with signatures gathered thereon.

The gathering chain conveyor system 10 shown in FIG. 1 includes a gathering chain system 12 including a gathering chain 14 having a plurality of gathering chain segments 15. The gathering chain 14, for example, may be a #40 DIAMOND bindery chain supplied by Diamond Chain Co. of Indianapolis, Ind. Inserted through corresponding openings in selected ones of the gathering chain segments 15 of the gathering chain 14 are gathering chain pushers 16 which gather and move signatures 18 during movement of the gathering chain 14. The gathering chain system 12 of the gathering chain conveyor system 10 may have sprockets (not shown) driven by motors (also not shown). These motors drive the gathering chain 14 and the gathering chain pushers 16 to move the signatures 18 between various operating stations which perform operations on the signatures 18.

Figure 2:
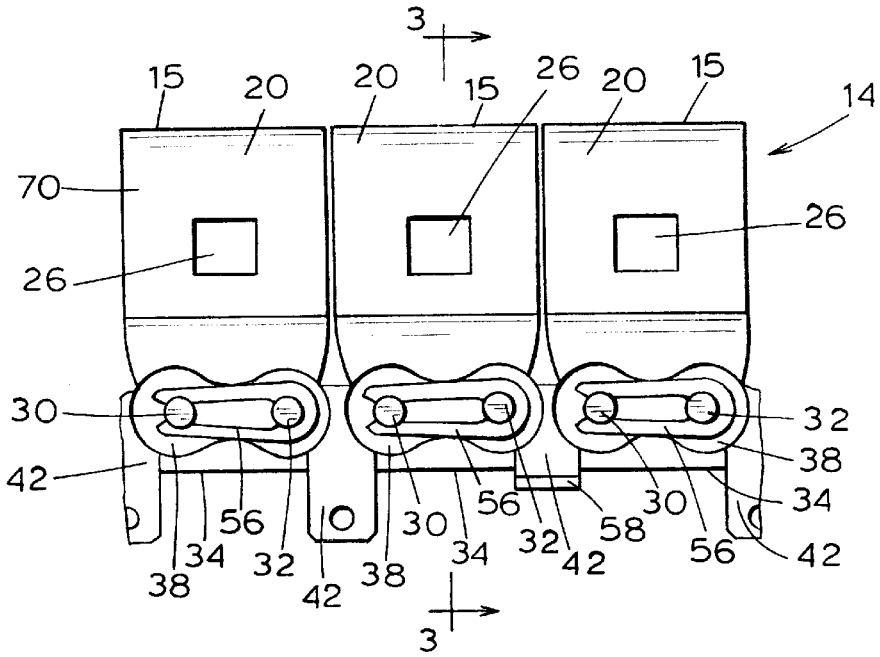
FIG. 2 is a fragmentary side elevational view of several gathering chain segments of the conveyor system of FIG. 1.
Figure 3:
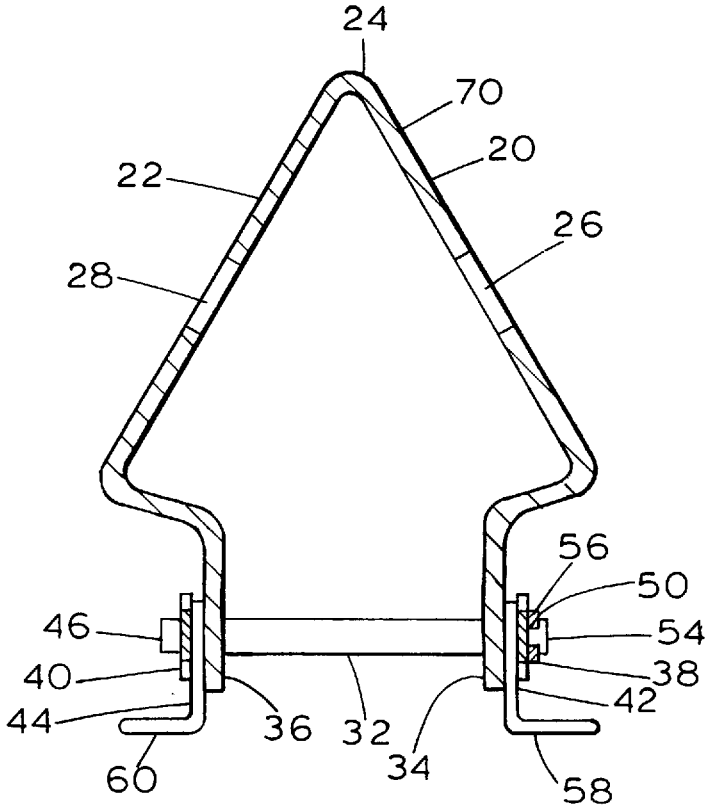
FIG. 3 is a sectional view taken generally along the lines 3—3 of FIG. 2.
Figure 4:
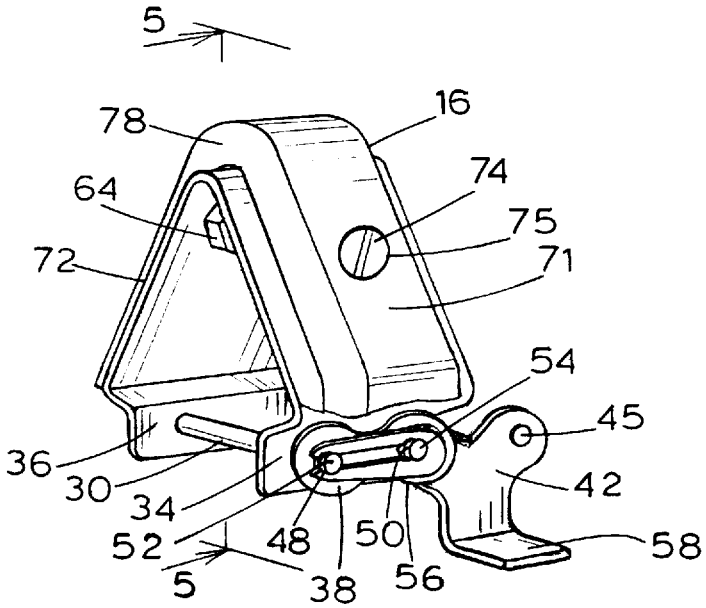
FIG. 4 is a perspective view of a gathering chain segment of FIG. 2 with a pusher member disposed thereon.

As seen in FIGS. 2–4, each gathering chain segment 15 has a generally inverted V-shape and includes first and second depending legs 20 and 22 joined at an apex 24. Aligned rectangular openings 26 and 28 extend through the legs 20 and 22, respectively. Spaced front and rear connecting rods 30 and 32, respectively, extend between lower ends 34 and 36 of the legs 20 and 22.

First chain links 38 and 40 overlie and abut outside surfaces of second chain links 42 and 44, respectively. The second chain links 42 and 44, in turn, abut outside surfaces of the lower ends 34 and 36, respectively. The front and rear connecting rods 30 and 32 extend through openings in these structures and each of the rods, 30 and 32, include a head (only a head 46 of the connecting rod 32 is visible in the Figs.) which abuts and retains the chain link 40 against the chain link 44 and the outside surface of the lower end 36 of the leg 22. The front and rear connecting rods 30 and 32 have grooves 48 and 50 adjacent further heads 52 and 54, respectively, for receiving a retaining clip 56 in a conventional manner so that the clip 56 is retained by the heads 52 and 54 against the chain link 38. In this manner the chain link 38 is urged against the chain link 42 and the lower end 34 of the depending leg 20.

Legs 58 and 60 of the chain links 42 and 44, respectively, are directed outwardly transverse to the direction of travel of the chain 14. These outwardly directed legs 58 and 60 of the chain links 42 and 44 are located at appropriately spaced intervals along the length of the chain 14 in order to properly support the chain during travel in a return travel path, as shown in greater detail hereinafter in connection with FIG. 5.

Figure 5:
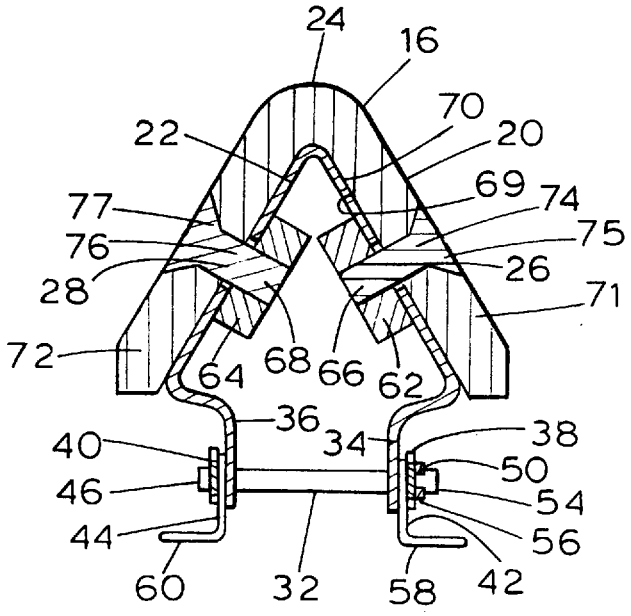
FIG. 5 is a sectional view taken generally along the lines 5—5 of FIG. 4.
Figure 6:
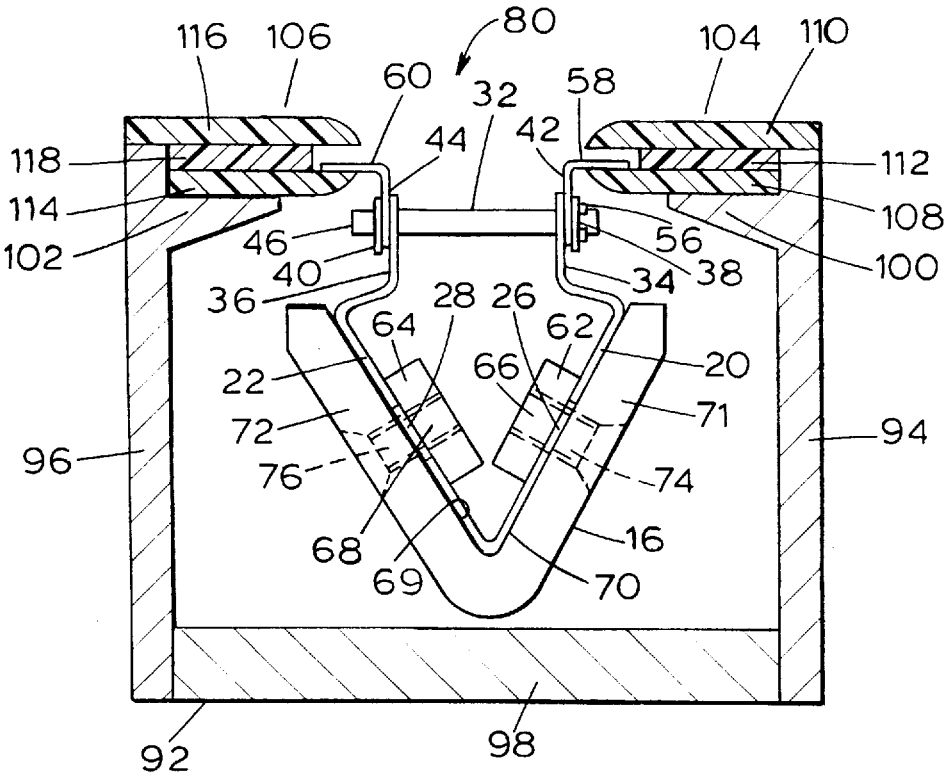
FIG. 6 is a sectional view taken generally along the lines 6—6 of FIG. 1 showing the track within which the outwardly extended tabs of FIG. 3 are captured during the return travel of the gathering chain.

Referring to FIGS. 4–6, weld nuts 62 and 64, or any other equivalent fastening devices, are mounted securely, such as by welding, to inside walls of the first and second legs 20 and 22, respectively, of the gathering chain segment 15. The weld nuts 62 and 64 have threaded weld nut openings 66 and 68 therethrough, respectively, which are aligned with the openings 26 and 28 of the depending legs 20 and 22, respectively.

Preferably, the gathering chain pushers 16 are identical and each has an undersurface 69 of an inverted V-shape substantially matching that of an upper surface 70 of the gathering chain segment 15. Each gathering chain pusher 16 has first and second pusher legs 71 and 72, respectively, that include openings 74 and 76 therethrough in alignment with the openings 26 and 28 of the first and second depending legs 20 and 22, respectively. The gathering chain pusher 16 is mounted on the selected gathering chain segment 15 by fasteners 75 and 77 that pass through the openings 74 and 76 and the openings 26 and 28 and are threaded into the weld nuts 62 and 64, respectively.

As seen in FIG. 4, each pusher 16 includes a leading wall 78 which is preferably substantially planar and perpendicular to the direction of travel of the gathering chain 14 and which has a portion having a thickness (i.e., a dimension extending substantially perpendicular to the legs 20 or 22) equal to or greater than the greatest anticipated combined thicknesses of the signatures 18 to be placed on the chain 14. Further, this portion of the leading wall 78 preferably has a transverse dimension (i.e., an overall side-to-side extent as seen in FIG. 5) which is sufficient to distribute impact forces over a substantial length of the edges of the signatures contacted by the leading wall 78 during gathering. In the example shown in the Figs., the portion of the leading wall 78 extends at least over substantially the entire width of the pusher 16. During gathering, impact forces resulting from striking of the signatures 18 are spread out by the relatively large area of the leading wall 78 so that deformation of the signatures 18 is substantially prevented, even when the gathering chain 14 is moving at high speed. Thus, the speed of the gathering chain 14 might be advantageously increased without an increase in the incidence of deformed signatures.

It should be noted that the length of each pusher 16 (i.e., the dimension along the direction of travel) is not critical, as long as sufficient material is provided to impart the required strength and to permit secure attachment of the pusher 16 to the associated segment 15. In the illustrated embodiment, the length of each pusher 16 is less than or substantially equal to the length of a segment 15.

The gathering chain conveyor system 10 includes a return portion 80 through which the gathering chain 14 travels on a return path. During this return trip the gathering chain 15 must be supported in order to avoid interference with other mechanical portions of the gathering chain conveyor system 10. A housing 92 is provided comprising first and second vertical supporting walls 94 and 96 secured by welds, or other attaching means, to a horizontal supporting base 98. Upper portions 100 and 102 of the supporting walls 94 and 96 are secured to first and second rail assemblies 104 and 106 by any suitable means, such as an adhesive. The rail assemblies 104 and 106 are preferably made of a material which provides a smooth return travel path for the gathering chain 15, such as lubricated ultra high molecular weight (UHMW) polyethylene. The rail assembly 104 includes a planar rail 108 which supports the gathering chain 14 by virtue of the outwardly extending legs 58 of the chain links 42. The rail assembly 104 also includes a retaining member 110 which is separated from the planar rail 108 by a spacer 112. The rail 108, the spacer 112, and the retaining member 110 are secured to one another by an adhesive or any other suitable means.

The rail assembly 106 is identical to the assembly 104 and includes a planar rail 114, a retaining member 116 and a spacer 118. The rail 114 supports the outwardly extending legs 60 of the chain links 44.

The gathering chain 14 is brought into position for transport into the housing 92 by means of a freely rotating idler wheel (not shown) or similar device to guide the legs 58 and 60 of the chain links 42 and 44 into the gaps or spaces between the members 108 and 110 and the members 114 and 116. The purpose of the rail assemblies 104 and 106 is to guide and retain the gathering chain 14 during travel in the return path such that the gathering chain 14 is not allowed to travel significantly down or side-to-side. Thus, possible contact and/or interference with mechanical devices in the vicinity of the return path is avoided. The rail assemblies 104 and 106 comprise only one possible method of guiding the gathering chain 14 during travel in the return path and any other means for performing this function might alternatively be used. Accordingly, this invention permits high speed binding to occur without deformation by distributing forces over an area of the signature, including the backbone which is the strongest portion.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A gathering chain, comprising:

a plurality of segments joined to one another and extending in a travel direction wherein each segment has a width transverse to the travel direction and includes a top surface; and a pusher member disposed atop one of the segments in contact with the top surface and having a portion extending to a uniform thickness above the top surface over the entire width of such segment and adapted to engage signatures deposited on the gathering chain.

2. The gathering chain of claim 1, wherein the one segment and the pusher member have an inverted V-shape.

3. The gathering chain of claim 1, further including means for attaching the pusher member to the one segment.

4. The gathering chain of claim 3, wherein said attaching means comprises a threaded bolt extending through an aperture in the pusher member.

5. The gathering chain of claim 4, wherein the one segment carries a member having a threaded bore therein and wherein the threaded bolt is captured within the threaded bore.

6. In a conveyor system having a gathering chain including a plurality of chain links, said chain links moving in a closed loop defined in part by a return path of travel, the improvement comprising:

a return path housing extending along the return path having an open upper portion and an enclosed lower portion;

a rail secured to the return path housing adjacent the upper portion; and a plurality of tabs carried by selective ones of the chain links and engaging the rail wherein the chain is supported within the return path housing by the rail along the return path of travel.

7. The improvement of claim 6, wherein the tabs extend outwardly transverse to the return path of travel.

8. The improvement of claim 6, wherein the rail is fabricated of an ultra high molecular weight polymer.

9. The improvement of claim 8, wherein the rail is planar, and further including a spacer and a retainer member secured to the rail arranged to capture the tabs of the chain links.

10. The improvement of claim 9, wherein the spacer is secured between the retainer member and the rail and the outwardly extending tabs ride upon the rail during movement of the gathering chain in the return path of travel.

11. A conveyor system, comprising:

a gathering chain having a plurality of chain links moving in a closed loop defined in part by a return path of travel and a plurality of segments joined to one another and driven by the chain links wherein each segment has a width transverse to the return path of travel and includes a top surface;

a pusher member disposed atop one of the segments in contact with the top surface, the pusher member having a signature contact surface extending a uniform thickness above the top surface over the entire width of such segment and adapted to engage signatures deposited on the gathering chain; and means adjacent the gathering chain for supporting the chain links along the return path of travel.

12. The conveyor system of claim 11, wherein the one segment and the pusher member have an inverted V-shape.

13. The conveyor system of claim 11, further including means for attaching the pusher member to the one segment.

14. The conveyor system of claim 13, wherein said attaching means comprises a threaded bolt extending through an aperture in the pusher member.

15. The conveyor system of claim 14, wherein the one segment carries a member having a threaded bore therein and wherein the threaded bolt is captured within the threaded bore.

16. The conveyor system of claim 15, wherein the supporting means includes a rail extending parallel to the gathering chain adjacent the return path of travel.

17. The conveyor system of claim 16, wherein the rail is fabricated of an ultra high molecular weight polymer.

18. The conveyor system of claim 17, wherein the supporting means further includes a plurality of tabs carried by selective ones of the chain links and engaging the rail.

19. The conveyor system of claim 18, wherein the tabs extend outwardly transverse to the return path of travel.

20. The conveyor system of claim 19, wherein the rail is planar and wherein the supporting means further includes a spacer and a retainer member secured to the rail and arranged to capture the outwardly extending tabs of the chain links.

21. The conveyor system of claim 20, wherein the spacer is secured between the retainer member and the rail and the outwardly extending tabs ride upon the rail during movement of the gathering chain in the return path of travel.

22. A pusher member for a gathering chain wherein the chain includes a plurality of segments joined to one another and wherein each segment has a width and an upper surface, comprising:

a body having an undersurface for placement on a segment upper surface and an engagement surface extending a uniform thickness above the upper surface over at least a width of a segment for engaging a signature; and means for securing the pusher member to a segment.

23. The pusher member of claim 22, wherein the engagement surface is planar.

24. The pusher member of claim 22, wherein the upper surface of each segment and the undersurface of the body are V-shaped.

25. The pusher member of claim 22, wherein the securing means comprises a pair of fasteners extending into weld nuts carried by a segment.

26. The gathering chain of claim 2, the segment comprising a first leg and a second leg extending downwardly from an apex; and the portion extending from a lower portion of the first leg to the apex and from a lower portion of the second leg to the apex.

27. The conveyor system of claim 12, the segment comprising a first leg and a second leg extending downwardly from an apex; and the signature contact surface extending from a lower portion of the first leg to the apex and from a lower portion of the second leg to the apex.

28. The conveyor system of claim 11, the supporting means comprising:

a return path housing including a first supporting wall and a second supporting wall, the first supporting wall and the second supporting wall enclosed at a lower portion and open at an upper portion of the return path housing;

a rail including a first rail member and a second rail member, the first rail member secured to the upper portion and extending into the return path housing and the second rail member secured to the upper portion and extending into the return path housing; and a plurality of tabs carried by selective ones of the chain links and engaging the rail wherein the chain is supported within the return path housing by the first rail member and the second rail member along the return path of travel.

29. The pusher member of claim 22, the segment comprising an apex and a first leg and a second leg extending downwardly from the apex, the engagement surface extending from a lower portion of the first leg to the apex and from a lower portion of the second leg to the apex.

* * * * *